US006799496B2

(12) United States Patent
Verhaeghe

(10) Patent No.: US 6,799,496 B2
(45) Date of Patent: Oct. 5, 2004

(54) METHOD AND APPARATUS FOR SLICING A NUMBER OF ARTICLES INTO A PLURALITY OF UNIFORM THIN SLICES IN A SINGLE OPERATION

(75) Inventor: Jozeff Jan Verhaeghe, Lendelede (BE)

(73) Assignee: Verhaeghe-Decock, Oostrozebeke (BE)

( * ) Notice: Subject to any disclaimer, the term of this patent is extended or adjusted under 35 U.S.C. 154(b) by 0 days.

(21) Appl. No.: 10/096,522

(22) Filed: Mar. 8, 2002

(65) Prior Publication Data

US 2002/0170398 A1 Nov. 21, 2002

Related U.S. Application Data

(60) Provisional application No. 60/274,682, filed on Mar. 9, 2001.

(30) Foreign Application Priority Data

Mar. 9, 2001 (EP) ..... 01870040

(51) Int. Cl.[7] ..... B26D 1/00

(52) U.S. Cl. ..... 83/167; 83/409.1; 83/618; 83/932

(58) Field of Search ..... 83/932, 874, 409, 83/409.1, 167, 89, 90, 102, 618, 622, 454, 437.1; 426/518; 99/537–539, 485

(56) References Cited

U.S. PATENT DOCUMENTS

| | | | | | |
|---|---|---|---|---|---|
| 2,262,882 | A | * | 11/1941 | Bucklin | 83/89 |
| 3,057,386 | A | * | 10/1962 | Massaro | 426/518 |
| 3,245,447 | A | * | 4/1966 | Jones | 83/167 |
| RE26,796 | E | * | 2/1970 | Lamb | 426/518 |
| 3,561,511 | A | * | 2/1971 | Kummer | 99/537 |
| 3,722,339 | A | * | 3/1973 | Boyer | 83/932 |
| 3,800,649 | A | * | 4/1974 | Chinn | 83/466.1 |
| 3,948,132 | A | | 4/1976 | Camp | |
| 4,184,397 | A | | 1/1980 | Jones | |
| 4,436,011 | A | * | 3/1984 | Jones | 99/537 |
| 4,625,364 | A | * | 12/1986 | Adams | 83/466.1 |
| 4,985,268 | A | | 1/1991 | Bingham | |
| 5,161,447 | A | * | 11/1992 | Emsens | 83/644 |
| 5,662,033 | A | * | 9/1997 | Yawman | 83/932 |

FOREIGN PATENT DOCUMENTS

| | | |
|---|---|---|
| GB | 600131 | 9/1945 |

* cited by examiner

*Primary Examiner*—Stephen Choi
(74) *Attorney, Agent, or Firm*—Knobbe, Martens, Olson & Bear, LLP

(57) ABSTRACT

A slicing device for slicing a number of articles in one slicing operation. The device includes a frame, a plurality of horizontally disposed cutting blades mounted in the frame, a pusher pushing the article into the cutting blades, and a support positioned between the cutting blades and the pusher. The support is able to support, at least temporarily, the articles prior to slicing. A collector is positioned underneath the cutting blades for collection of the sliced articles. The collector includes first and second collection units for collection of the end and intermediate slices respectively. Further, a method for slicing the article into a plurality of slices, includes the steps of:

slicing the article into a number of slices resulting in two end slices and a number of intermediate slices, the intermediate slices being of uniform thickness, and collecting the intermediate slices and the end slices.

15 Claims, 4 Drawing Sheets

METHOD AND APPARATUS FOR SLICING A NUMBER OF ARTICLES INTO A PLURALITY OF UNIFORM THIN SLICES IN A SINGLE OPERATION

RELATED APPLICATIONS

This application claims the benefit of the U.S. Provisional Application No. 60/274,682 and the European Patent Office Application No. EP 01870040.1 both filed Mar. 9, 2001.

BACKGROUND OF THE INVENTION

1. Field of the Invention

The invention relates to a method and an apparatus for slicing a number of articles, such as vegetables and fruit, and, more in particular, for slicing tomatoes thereby resulting in a plurality of uniform thin slices in a single slicing operation.

The apparatus and the method according to the invention are able to slice several, in general a series of two up to ten or more, articles. Most particularly, the invention is related to slicing a series of tomatoes.

2. Description of the Related Art

Several different slicing apparatuses and methods are known. Devices and methods for cutting or slicing fruits and vegetables are known in the art and, in fact, certain well known hand-operated devices have been developed for cutting or slicing only tomatoes. For instance, U.S. Pat. No. 3,948,132 ('132) describes an apparatus for slicing fruit and vegetables such as potatoes, carrots and onions, as well as tomatoes, hard boiled eggs and the like. A set of parallel cutting blades is positioned into a horizontal plane provided with a frame member for initially receiving the article to be cut. Further an article engaging member is provided for engaging and forcing the article through the cutting blades.

Although the apparatus disclosed in the '132 reference is for slicing tomatoes, the pushing direction of the pusher elements is, at least in the beginning of the slicing, not perpendicular to the direction of the cutting plane. As this is, particularly for slicing tomatoes, of extreme importance, it is therewith difficult to obtain accurate slices and the risk of squashing the tomatoes will be present.

Various other devices are available for slicing tomatoes and other soft fruit and vegetables by utilizing a pusher with spaced fingers for pushing the tomato, fruit, or vegetable at an angle along between a rack of sharp parallel spaced blades. Several of these devices are known being enhanced by holding the blades as rigidly as possible, making them simple, free acting, and dependable.

U.S. Pat. No. 4,184,397 describes a further enhancement in which a substantially vertical, hollow, triangular enclosure frame is included having a substantially wedged-shaped interior space, bounded by three sides, as a pushing unit. However, again the movement of the pusher towards the cutting plane is not always perpendicular thereto.

The consensus regarding the mode of operation of the above-mentioned devices seems to be that articles, such as tomatoes with their relatively thick skins, should be pushed through the fixed cutting blades with a slight amount of rotation of the article in certain instances, to improve the mentioned slicing apparatuses. The problem of all above-mentioned slicing apparatuses, however, is that uniform slices are difficult to obtain therewith. The problem with slicing tomatoes in particular is that they are squashed, rather than sliced.

A slicing device and method in which a rotational movement of the objects to be sliced is not required, has been described, for instance in GB 600,131. Herein, an old technique and device for slicing and chipping hard vegetables, such as potatoes, carrots, or similar tubers is disclosed. The vegetables, which do not undergo any rotational movement, are pushed perpendicularly through a bed of fixed cutting blades. The device comprises a cutter frame provided with fixed cutting wires or blades supporting the vegetable, and a pusher element that pushes the vegetable through the cutter frame. Using this particular device a central portion of vegetables can be sliced into thin slices, while the more irregular ends of the vegetables are cut into larger and thicker pieces. These two types of sliced vegetable pieces are collected in separate pails.

Although this old cutting technique facilitates obtaining uniform slices of an article, it is not generally suitable for cutting vegetables with a soft texture, such as tomatoes. As the cutting frame consists of fixed cutting wire or blades, a considerable pushing force is necessary to push the vegetables through this cutting frame. In the particular case of slicing tomatoes, this pushing mechanism would often result in squashing rather than slicing the tomatoes. In addition, the device comprises the collection of the sliced articles into pails, which does not allow further easy and hygienic handling or transport.

U.S. Pat. No. 4,985,268 describes an apparatus and method to obtain uniform slices of pineapples. The apparatus includes a device for removing the ends of the pineapples, a slicing device to slice the remaining part of the pineapples into discs, a grading device for grading discs according to diameter and a de-skinning and coring machine for treating the graded discs.

Once again, this device may provide a method to obtain uniform slices of an article, but is time-consuming as the separation of the non-desired end parts, the slicing of the intermediates discs and their collection is performed in several operational steps and devices. Moreover, long-lasting handling procedures before final collection of the desired slices may improve non-hygienic circumstances. In addition, this device is not suitable for slicing vegetable or fruits that do not need to be de-skinned or cored, such as tomatoes.

SUMMARY OF THE INVENTION

The invention offers improvements to the known apparatuses and methods which, in particular, are directed to the non-rotational movement of the objects to be sliced. The main object of the present invention is to provide a uniform thickness of the collected slices and to collect the sliced articles in a hygienic and practical way.

It is therefore an object of the invention to provide a method and an apparatus for slicing vegetables and fruit, in particular for slicing tomatoes, which results in a plurality of uniform, thin slices in a single operation. All known slicing apparatuses result in an array of slices of which at least two slices, i.e. the end slices (in general the extreme left and right slices), per sliced article are not equal to the thickness of the intermediate slices. Uniform thickness of the intermediate slices is generally obtained due to the correct parallel alignment of the cutting blades. As the size of the article along the cutting plane is in general not exactly equal to an integer multiple of the width of a plurality of cutting blades, the sliced article results in a number of equally thick sliced intermediate slices and two, i.e. in general an extreme left and an extreme right end slice, having a thickness smaller than the intermediate slices. In particular for tomatoes, but also for a number of other fruits and vegetables, these end slices are from a consumer point of view not desired.

The invention provides a device and a method which are able to separate the end slices, which are generally of a different thickness than the equally thick sliced intermediate slices, and further to collect the intermediate slices in a single operational step. In addition, the invention is related to further improvements such that all slices are of a uniform size and neatly and hygienically sliced and packaged.

In a first aspect, the invention provides a slicing device for slicing a number of articles in one slicing operation, comprising a frame, a plurality of horizontally disposed cutting blades mounted in the frame for receiving an article to be sliced, an article pushing member pushing the article into the cutting blades and a support member positioned between the cutting blades and the pushing member, wherein the support member is able to support, at least temporarily, the articles prior to slicing, and a collector positioned underneath the cutting blades for the collection of the sliced articles, wherein the collector comprises a first collection unit for the collection of the end slices and a second collection unit for the collection of the intermediate slices.

By providing two separate collection units, namely a first collection unit for the collection of the end slices and a second collection unit for the collection of the intermediate slices, the device of the present invention provides for the possibility of only collecting the intermediate desired slices having a uniform slice breadth. The collection of the intermediate slices will result in a series of slices of a uniform thickness. If an array of five tomatoes is, for example, being sliced, the left and right end slices (in total: 5×2=10) will be collected via the first collection unit and transferred away from the collection of the desired fraction being the intermediate slices. All the intermediate slices of all the tomatoes can then be further collected via the second collection unit according to the invention. As already explained above, left and right hand end slices of vegetables and, more in particular of tomatoes, are not desired by the consumer as they possess less tasty components such as style pieces, stalk pieces, the sepal, calyx pieces, peduncule pieces, and root pieces. The invention solves these inconveniences by offering a device that enables the collection of the desired slices only, being the intermediate slices.

In a second aspect, the invention relates to a method for slicing an article into a plurality of slices having an equal thickness, the method comprising the steps of slicing the article into a number of slices resulting in two end slices and a number of intermediate slices, the intermediate slices being of a uniform thickness, collecting the intermediate slices, and collecting the end slices.

The method of the present invention facilitates slicing different kinds of articles into uniform slices and collecting the slices of an equal thickness in such a way that immediate transport or use is allowed. Particularly advantageous is that this slicing process can be performed in a single operational step, which helps ensure hygienic handling and which is cost as well as time-effective. In a more preferred embodiment, the invention includes the use of the device according to the invention for slicing an article into a plurality of slices having an equal thickness.

Further advantages and improvements of the present slicing device and the method according to the invention are elucidated in the following detailed description and will be further explained in detail with reference to the accompanying drawings.

DETAILED DESCRIPTION OF THE PREFERRED EMBODIMENT

Figure 1:
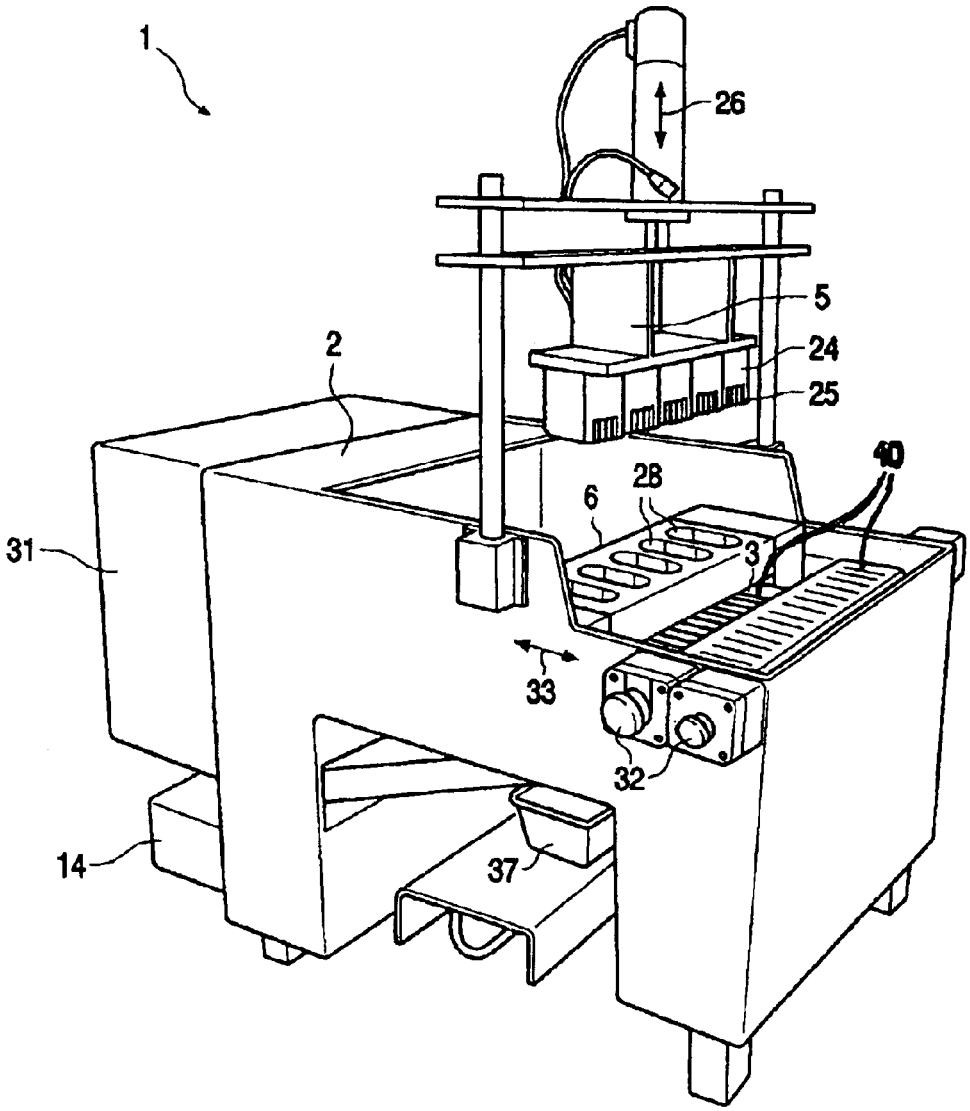
FIG. 1 is a schematic overview of a preferred embodiment of a slicing apparatus according to the invention.
Figure 2A:
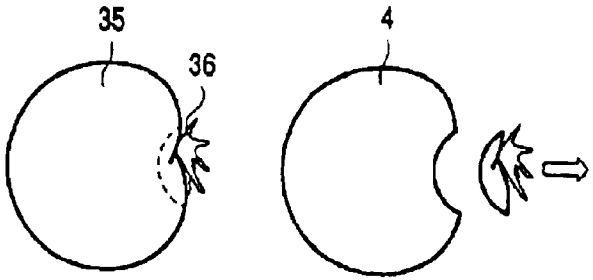
FIG. 2*a* is a schematic cross sectional view of a tomato.

FIG. 1 depicts a slicing device 1 for slicing a number of articles 4 (FIGS. 2*a* and 2*b*) in one slicing operation. The device 1 comprises a frame 2 wherein a plurality of horizontally disposed cutting blades 3 are mounted for receiving the articles 4 to be sliced. The device 1 further comprises an article pushing member 5 for pushing the articles 4 into the cutting blades 3. Above the cutting blades 3, a support member 6 is positioned between the cutting blades 3 and the pushing member 5, such that the support member 6 is able to support at least temporarily, i.e. before the slicing or cutting operation takes place, the articles 4. The support member 6 is produced with holes 28 as a function of the dimensions of the articles 4 to be sliced and the number of articles 4 that have to be sliced. For example, for slicing cucumbers, only one hole 28 needs to be provided in the support 6. Then the width of the support 6 is much more important than the length. The support member 6 can be made of ERTALON and is positioned in between the cutting blades 3 and the pushing member 5. Holes 28 are provided in the support 6 for supporting the articles 4 prior to being sliced.

The pushing member 5 can be fixed on a guiding plate and the pushing member 5 can move vertically (arrow 26) along two guiding bars. In one embodiment, the pushing member 5 comprises a number of pushing elements 24 equal to the number of articles 4 to be sliced in one operation of the device 1. These pushing elements 24 are provided with spaced apart fingers 25 in order to be able to push the articles 4 at least partly through the cutting blades 3. Every pushing element 24 is movable to adjust the spaced apart fingers 25 through the cutting blades 3. On the guiding plate, spacers may be provided. These spacers fix the guiding plate to a fastening plate and can prevent torsion of the guiding plate. The pushing member 5 can be moved in a vertical direction (arrow 26) such that the pushing elements 24 can push the articles through holes 28 in the support member 6. The cutting blades 3 reciprocate into a horizontal direction, arrow 33. Reciprocation is in general performed with a high frequency. A pneumatic cylinder is fixed on the fastening plate. The pushing member 5 is pushed or pulled by this pneumatic cylinder. The course of the cylinder is dependent on the support member 6.

The cutting blades 3 may be positioned on two supports or cutting blade frames 40, which are installed in the middle of the frame 2. The cutting blades 3 of an upper support 40 can have a moving direction that is opposite to the moving direction of the cutting blades 3 of an under support 40. In addition, the thickness and edginess of the cutting blades 3 may be adapted to the texture and skin characteristics of the articles 4 to be sliced.

As the invention is particularly useful for cutting tomatoes, the following description will be directed to the cutting of tomatoes, in particular, to the cutting of a series of five tomatoes 35 as shown in FIG. 2*a* through FIG. 2*j*. Neither the number of articles 4, nor the specific kind of articles 4 should be understood as a limitation for the invention. As already explained above, the invention can be useful for cutting all kinds of articles 4 into slices having an equal slice thickness.

In general a tomato 35 can be cleaned and washed and the stem portion 36 can be cut off or bored out prior to undergoing the slicing operation. Cutting off the stem portion 36 is however not essential, but can be useful for the further treatment of the end slices being separately collected.

As, in this embodiment, the tomato 35 is the article 4 to be sliced, reference number 4 shall be used for the following description. In a first step of a preferred embodiment of the method according the invention, the article pushing member 5 with the respective pushing elements 24 shall push the articles 4 through the support member 6 onto a cutting plane.

Figure 2B:
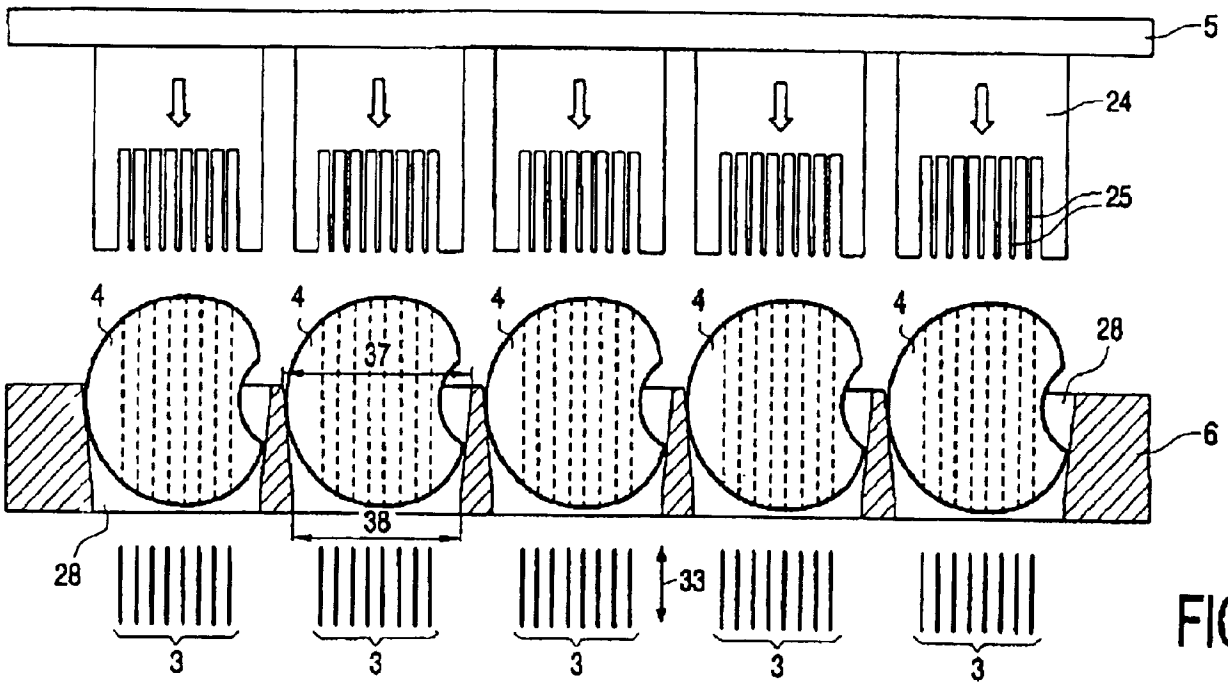
FIG. 2*b* through FIG. 2*j* are schematic cross sectional views of a preferred embodiment of the method according to the invention using the apparatus of FIG. 1 in subsequent steps from b to j.

The support member 6 comprises a series of holes 28 equal to the series of articles 4. As can be seen in FIG. 2*b* the upper diameter 37 is somewhat larger than the lower diameter 38 of the support 6. This difference results in the support of the articles 4 to be sliced being held up by a frictional engagement of the support member 6 on the articles 4. It should be understood that other frictional engagements, such as frictional fingers or other supporting means which are able to engage at least temporarily the article 4 to be sliced can be used.

For the purposes of the explanation it will be understood that a same kind of tomato having a similar dimension, in particular width, is used in the series to be sliced. A small difference in width being the sum of the width of the end pieces in average one and a half slice width is allowed.

The cutting blades 3 are reciprocated into a horizontal direction, preferably perpendicular to the direction of the pushing member 5. Arrow 26 extends perpendicular to arrow 33.

Figure 2C:
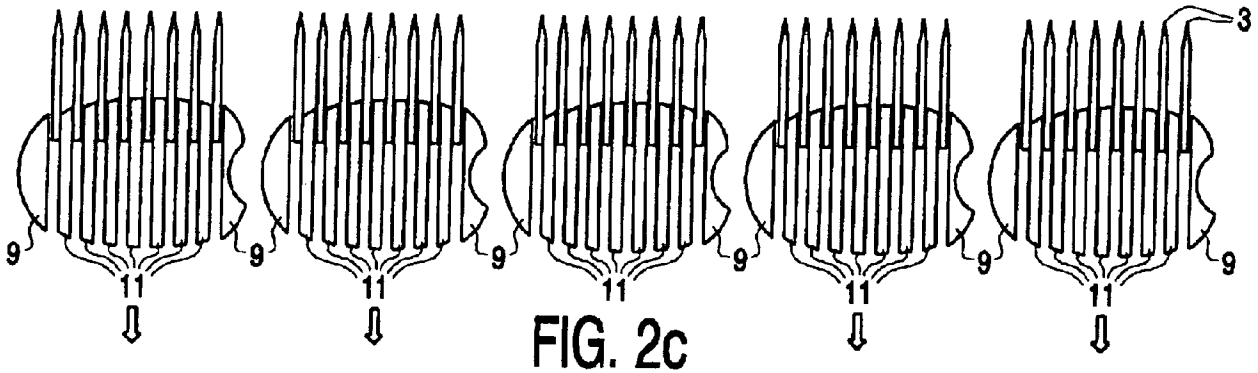
Figure 2D:
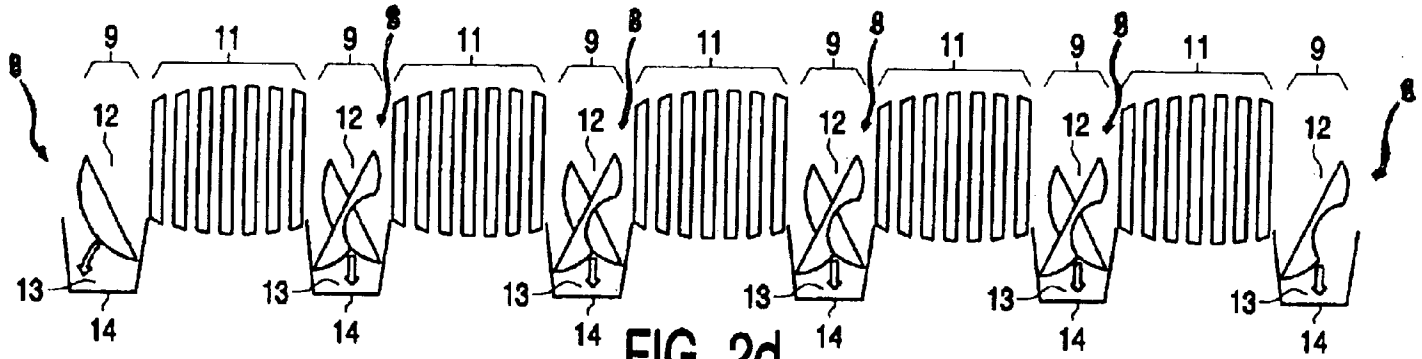
Figure 2E:
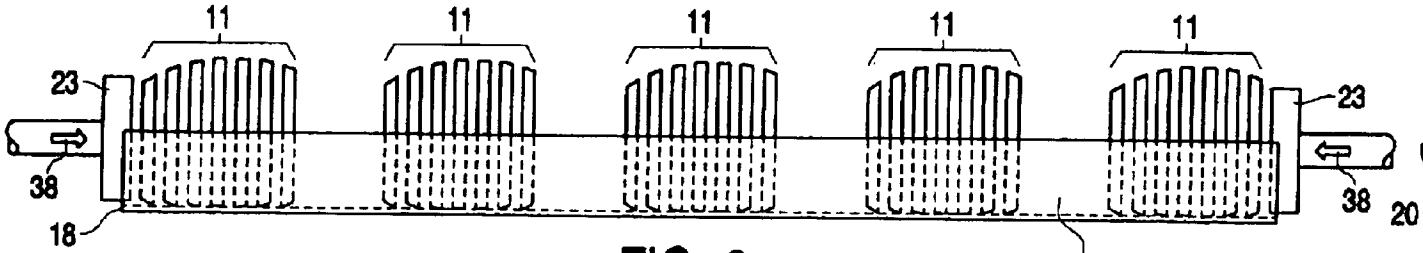

FIG. 2*c* shows the cutting blades 3 in a cutting operation resulting in a number of seven intermediate slices 11 and two end slices 9 per article 4. The two end slices 9 per article 4 are collected in the first collection unit 8. The first collection unit 8 includes a number of inlets 12 wherein the end slices 9 are collected. In a preferred embodiment, the first collection unit 8 includes gravity conveyors 13 made out of stainless steel, in particular made of stainless steel having a relief surface such that the end slices 9 are guided via the gravity conveyor 13 to a first collection container 14 for further treatment. As the number of articles 4 in this embodiment is five, the number of inlets 12 for the first collection unit 8 is five plus one or six. When the tomato end slices have fallen in the first collection units 8, they may be pushed away, for instance by profiles, which can be fastened on a bar. These profiles may be driven by two pneumatic cylinders. Due to the movement of these profiles, the end slices may fall down in a basket or a conveyor belt that can be installed under the device 1.

It is also an object of the invention to provide a device 1 in which the article 4 to be sliced during the slicing operation has a fixed position. An additional, unwanted movement of the article 4 to be sliced will decrease the quality of the obtained slices. In order to be able to provide for a fixed position during a cutting operation, the present invention provides for a specific cutting blade unit. The cutting blade unit includes two cutting blade frames 40, which frames 40 have an opposite direction of movement during slicing, backwards and forwards in a horizontal plane.

The cutting blades are positioned in an interlocking parallel way and are supported by the two above-mentioned cutting blade frames 40. Both frames 40 slide relatively towards each other in a same horizontal plane, having the same velocity but in an opposite direction. Thus, the cutting direction is comprised in this horizontal plane and the cutting movement goes backwards and forwards over a small distance.

The cutting blades of the first cutting blade frame 40 lay besides the cutting blades of the second cutting blade frame 40. The cutting blade frames 40 move simultaneously in substantially parallel horizontal planes in opposite directions, i.e. the cutting blades housed on the first cutting blade frame 40 go forward and simultaneously the cutting blades housed on the second cutting blade frame 40 go backwards in the same horizontal plane; the cutting blades housed on the first cutting blade frame 40 go backwards and simultaneously the cutting blades housed on the second cutting blade frame 40 go forward in the same horizontal plane; the cutting blades housed on the first cutting blade frame 40 go forward and simultaneously the cutting blades housed on the second cutting blade frame 40 go backwards in the same horizontal plane; the cutting blades housed on the first cutting blade frame 40 go backwards and simultaneously the cutting blades housed on the second cutting blade frame 40 go forward in the same horizontal plane; etc.

Due to this specific fashion of moving of the cutting blades, the resultant movement in this horizontal cutting plane is zero. Therefore, during working conditions the article 4 to be sliced does not undergo an additional movement because the resultant movement in this horizontal cutting plane is zero. The article 4 will only undergo a vertical downwards movement, i.e. falling due to gravitational forces and/or pushing, due to the activity of the pushing elements, upon cutting. The neatly cut slices will fall in a vertical fashion. The horizontal backwards and forward movement is only meant for cutting purposes and will not affect the horizontal position of the article 4 to be sliced.

Figure 2F:
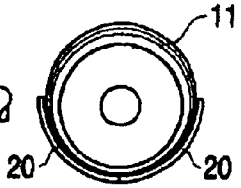
Figure 2H:
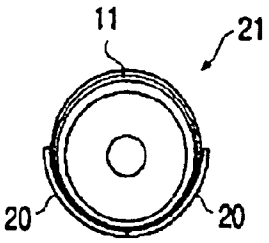
Figure 2G:
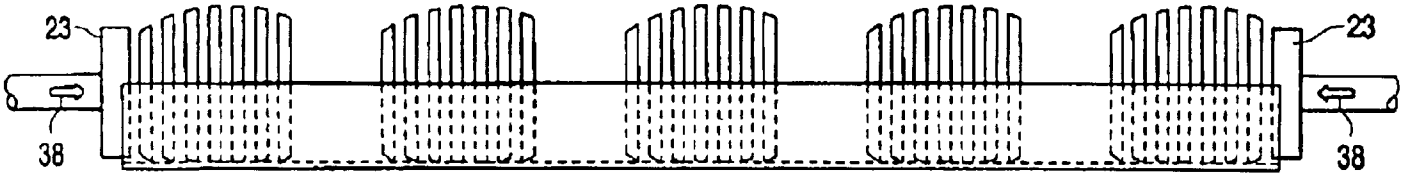
Figure 2J:
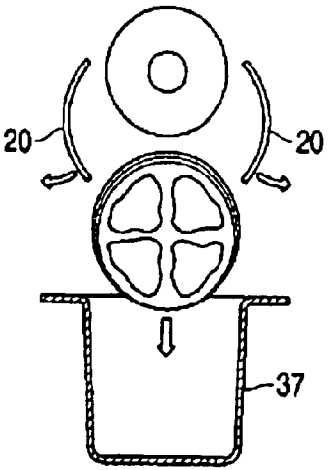
Figure 2I:
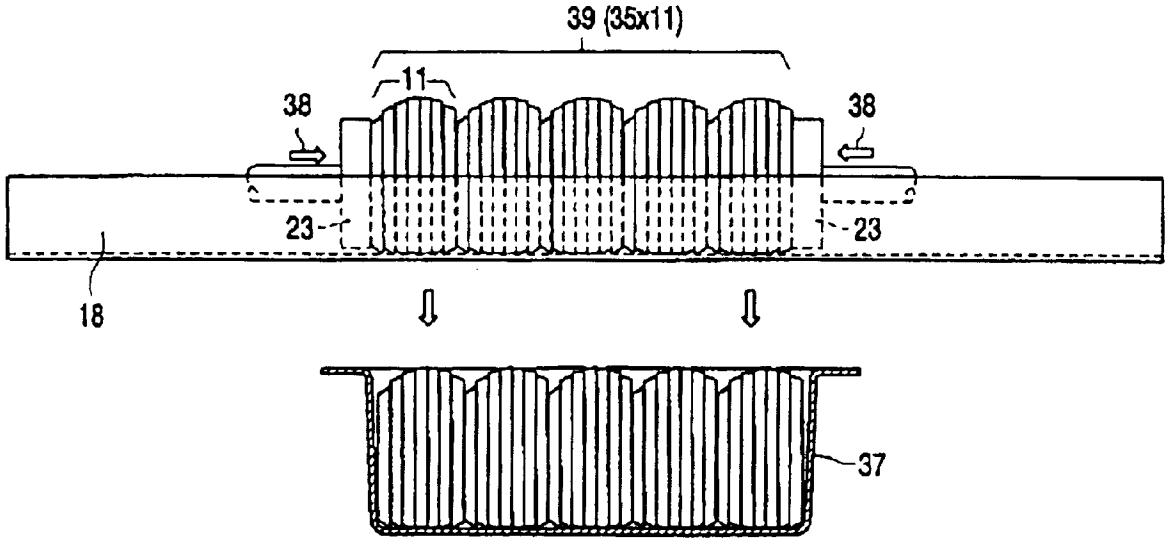

During the collection of the end slices 9, the intermediate slices 11 are also collected but separately, by a receiver 15 and while being received they are positioned by a positioner such that an upright alignment of the intermediate slices 11 on the receiver 15 is obtained. Such an upright alignment is preferred for further transport and dispensing. The receiver 15 includes a receiving groove 18 which, in a preferred embodiment, may include two movable legs 20 which can be opened and closed (FIGS. 2*f*, 2*h*, and 2*j*). A closed position 21 is required during the alignment positioning. Opening and closing of the legs 20 of the receiving groove 18 is driven by a pneumatic cylinder.

The receiving groove 18 is provided with means for transferring the received slices into second collection unit 37 including a collection tray. The shape of the receiving groove 18 may be chosen adapted to the size and shape of the articles 4. The receiving groove 18 is preferably rigidly fixed to the frame.

Two horizontally and axially aligned pushing rods 23 will be moved in a direction 38 when sliced and provide for a proper upright alignment 39 of the intermediate slices 11. In this alignment they can be transferred into the second collection unit 37 without loosing their initial positioning on the receiving groove 18. The pushing rods may include three plastic rollers that minimally damage the articles 4. The pushing rods can be driven by two pneumatic cylinders. The course and the speed of these cylinders may be adapted to the size of the articles 4.

As already explained above, the complete operation can be done in a time span less than 10 seconds. In preferred embodiments whereby a precise control of the pushing member 5 and the cutting blades 3 is obtained, a slicing operation in less than five seconds can be obtained. A further automation may result in that the initial transport of the articles 4 into the support member 6 and the further handling of the first 8 and second 37 collection units are automated.

When a proper alignment is obtained (FIG. 2*g*), the pushing rods 23 are moved. The pushing rods 23 push gently against the slices and form a more compact package of intermediate slices 11. Thirty five slices 39 having a uniform thickness are transferred into the second collection unit 37. The groove legs are therefor opened (from 2*h* to 2*j*) and, due to gravitational forces, the upstanding slices 39 are transferred into the second collection unit 37. Due to the fact that the slices have a uniform thickness, the second collection unit 37 will be filled exactly in the same fashion, which is, for further logistic purposes and standardization, an improvement.

A control unit 31 is provided to electronically, electro-pneumatically, hydraulically and/or mechanically or in any other way control the working conditions of the device 1. Appropriate switches 32 control the on/off working condition of the cutting blades 3 and the pushing member 5 in particular. The control of these apparatuses is known for the ordinarily skilled man.

For instance, the device 1 can go in action when several requirements are fulfilled. The main switch of the device 1 must stand on, an emergency stop must be switched off, a thermal safety needs to be switched off and the pneumatic cylinder must be positioned on top of the device 1. In addition, electric tension and compressed air need to be available. By pushing the start button, the device 1 can start a first cycle. The start button may need to be held until the pneumatic cylinder is completely down. The pneumatic cylinder goes rapidly down and the electrical motor goes in action, which causes the cutting blades 3 to reciprocate into a horizontal direction. The reciprocation is performed with a high frequency but can change in function of the electrical net.

When the pneumatic cylinder reaches a first middle sensor, the moving speed of the cylinder lowers. This speed of the pneumatic cylinder is adjusted and regulated by a valve, which is important to prevent squashing instead of pushing the articles 4 to be sliced. When the pneumatic cylinder reaches its lowest position, which is detected by a second sensor, the electrical motor stops. In case the start button of the device 1 is released before the pneumatic cylinder has reached its lowest position, the cylinder will return to its resting position.

The control unit of the device 1 is programmed to automatically activate different other pneumatic cylinders forming part of the device 1 upon release of a signal by the second sensor. When the sliced article 39 is located in the receiving groove 18, the cylinders controlling the pushing rods 23, will be activated and the sliced articles 39 will be pushed together. Subsequently, after this action, the cylinders controlling the pushing rods 23 return to a resting position and meanwhile, the movable legs 20 forming the receiving groove 18 are opened and the sliced articles 39 fall into the second collection unit 37.

It is clear that the efficacy of the device 1 and the method of the invention will depend on the rapidity and sharpness of the cutting blades 3. A rapid and efficient slicing of the article 4 ensures hygienic handling. It should be apparent and understood that the disclosure and teachings of the present invention will include alternative designs within the scope of the present invention.

What is claimed is:

1. A slicing device for slicing a number of articles in one slicing operation, the device comprising:

a frame;

a first and a second cutting blade frames interconnected to the frame such that the cutting blade frames simultaneously in substantially parallel horizontal planes in opposite directions;

a plurality of cutting blades supported by the cutting blade frames such that the plurality of cutting blades are arranged substantially horizontally parallel to each other for simultaneously slicing articles into intermediate slices and end slices;

an article pushing member pushing the article into the cutting blades;

a support member positioned between the cutting blades and the pushing member, wherein the support member is adapted to support, at least temporarily, the articles prior to slicing and wherein the articles are pushed by the pushing member through the support member during slicing; and a collector positioned underneath the cutting blades for the collection of the sliced articles, the collector comprising a first collection unit for the collection of the end slices and a second collection unit for the collection of the intermediates slices.

2. The device of claim 1, wherein the first collection unit comprises a plurality of inlets positioned underneath the cutting blades for the collection of one or two end slices.

3. A slicing device for slicing a number of articles in one slicing operation, the device comprising:

a frame;

a first and a second cutting blade frames interconnected to the frame such that the cutting blade frames simultaneously in substantially parallel horizontal planes in opposite directions;

a plurality of cutting blades supported by the cutting blade frames such that the plurality of cutting blades are arranged substantially horizontally parallel to each other for simultaneously slicing articles into intermediate slices and end slices;

an article pushing member pushing the article into the cutting blades;

a support member positioned between the cutting blades and the pushing member, wherein the support member is adapted to support, at least temporarily, the articles prior to slicing and wherein the articles are pushed by the pushing member through the support member during slicing; and a collector positioned underneath the cutting blades for the collection of the sliced articles, whereby the collector comprises a first collection unit for the collection of the end slices, and a second collection unit for the collection of the intermediate slices, and a plurality of gravity conveyors wherein the first collection unit comprises a plurality of inlets positioned underneath the cutting blades for the collection of one or two end slices and wherein the first collection unit is positioned such that the end slices will be guided along the gravity conveyors into the first collection unit.

4. The device of claim 3, wherein the number of the inlets and gravity conveyors is equal to the number of sliceable articles in one slicing operation plus one.

5. The device of claim 3, wherein the second collection unit comprises:

a receiver for receiving the intermediate slices, a positioner providing alignment of the intermediate slices; and a collection tray for the collection of the intermediate slices.

6. The device of claim 5, wherein the receiver comprises a receiving groove and wherein the positioner transfers the received intermediate slices to the collection tray.

7. The device of claim 3, wherein the second collection unit comprises:

a receiver for receiving the intermediate slices, a positioner providing alignment of the intermediate slices; and a collection tray for collection of the intermediate slices wherein the receiver comprises a receiving groove and means for transferring the received slices to the collection tray and wherein the receiving groove comprises two pivotable legs positionable into a closed position for receiving the intermediate slices during positioning and an open position for transferring the intermediate slices to the collection tray.

8. The device of claim 7, wherein the positioner comprises two horizontally and axially aligned pushing rods.

9. The device of claim 3, wherein the pushing member comprises a plurality of pushing elements equal to the number of sliced articles in one slicing operation, the pushing elements comprising spaced apart fingers, wherein the pushing elements are movable to adjust the spaced apart fingers through the cutting blades.

10. The device of claim 9, wherein the pushing member is adapted to move in a vertical direction upwards and downwards.

11. The device of claim 10, wherein the vertical direction is perpendicular to the cutting blades.

12. The device of claim 3, wherein the supporting member is formed by a template comprising a plurality of holes adapted to support the articles to be sliced.

13. The device of claim 12, wherein the supporting member is adapted to temporarily support an article to be sliced in a friction engagement of an article with a corresponding hole.

14. The device of claim 12, wherein the holes have a conical cross section.

15. The device of claim 3, comprising a cutting blade unit wherein the two cutting blade frames are arranged within the cutting blade unit, wherein the cutting blade frames reciprocate towards and away from each other in the same horizontal direction such that the resultant horizontal movement is zero.

* * * * *

UNITED STATES PATENT AND TRADEMARK OFFICE

CERTIFICATE OF CORRECTION

PATENT NO. : 6,799,496 B2
DATED : October 5, 2004
INVENTOR(S) : Jozeff Jan Verhaeghe It is certified that error appears in the above-identified patent and that said Letters Patent is hereby corrected as shown below:

Title page,
Item [73], Assignee, insert -- nv -- before "Verhaeghe".

Column 7,
Line 51, after "blade frames" insert -- reciprocate --.

Column 8,
Line 13, after "blade frames" insert -- reciprocate --.
Line 32, after "slices" delete "and".

Signed and Sealed this

Sixteenth Day of May, 2006

JON W. DUDAS
*Director of the United States Patent and Trademark Office*